US006826125B2

(12) United States Patent
Sullenberger, III

(10) Patent No.: US 6,826,125 B2
(45) Date of Patent: Nov. 30, 2004

(54) NOVELTY CLOCK HAVING NUMBERED BALL DISPLAY

(76) Inventor: Charles E. Sullenberger, III, 1010 Mountain Laurel Rd., Morristown, TN (US) 37814

( * ) Notice: Subject to any disclaimer, the term of this patent is extended or adjusted under 35 U.S.C. 154(b) by 346 days.

(21) Appl. No.: 10/196,638

(22) Filed: Jul. 16, 2002

(65) Prior Publication Data

US 2004/0013044 A1 Jan. 22, 2004

(51) Int. Cl.[7] ..... G04B 19/00
(52) U.S. Cl. ..... 368/76; 368/223
(58) Field of Search ..... 368/76–78, 221–223, 368/225, 231–235

(56) References Cited

U.S. PATENT DOCUMENTS 3,852,949 A * 12/1974 Sayler ..... 368/76
4,277,841 A * 7/1981 Ogden ..... 368/78
5,299,178 A * 3/1994 Belik ..... 368/76
5,331,609 A * 7/1994 Gubin ..... 368/223

* cited by examiner

*Primary Examiner*—Kamand Cuneo
*Assistant Examiner*—Thanh S. Phan
(74) *Attorney, Agent, or Firm*—Pitts & Brittian, P.C.

(57) ABSTRACT

A novelty clock having a display comprised of replica pool balls. The clock is contained primarily within a housing having a front panel defining a time display opening through which the balls are passed. The balls are displayed on a shelf that is hinged to the front panel of the clock. The shelf is pivoted upwardly to withdraw the balls and is then lowered to return the balls the most forward position. Three carousels are provided for displaying one minute, ten minute and one hour increments of time. An array of ball receiving cells are defined by each carousel. A time display control mechanism is provided for moving at least the first carousel through a rotation of 36° each minute. The mechanism includes primarily a timing device, a motor, and a drive mechanism. At one minute intervals, the timing device actuates the motor. The motor is mounted on a bottom panel of the housing and includes an output shaft to which the drive mechanism is connected. When the motor is actuated, the output shaft imparts movement in the drive mechanism, which rotates the first carousel. In order to withdraw the balls, a lifting mechanism is provided for pivoting the shelf upward. As the shelf is pivoted such that its distal end is elevated above its proximal end, each of the balls is encouraged toward their respective ball receiving cells.

17 Claims, 13 Drawing Sheets

NOVELTY CLOCK HAVING NUMBERED BALL DISPLAY

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of Invention

This invention pertains to a novelty clock. More specifically, the present invention relates to a clock using numbered balls to display the current time.

2. Description of the Related Art

In the field of time keeping, there are many different novelty clocks having various types of displays. While the object of a clock is to properly display the correct time, novelty clocks are provided to display the correct time in a manner that is not only informative, but also entertaining. Novelty clocks have been provided to accomplish particular themes. For example, clock housings have been formed in various shapes, sizes, colors, and the like. Clocks have been made to look like various animals, sports objects, famous characters, and objects of art.

Several clocks have been designed to not only have a unique appearance, but also to display the time in a unique manner. Of specific interest in the present invention are clocks in which a plurality of balls, coins, or other objects are provided for the display of the current time. The plurality of objects are individually manipulated in order to accomplish this task. In several of the prior art devices, the objects are moved into particular viewable positions for displaying the time. Typical of the art are those devices disclosed in the following U.S. Patents:

| U.S. Pat. No. | Inventor(s) | Issue Date |
|---|---|---|
| 4,077,198 | H. Mayenschein | Mar. 7, 1978 |
| 4,280,211 | H. Mayenschein | Jul. 21, 1981 |
| 4,370,064 | A. A. Hicks et al. | Jan. 25, 1983 |
| 4,421,415 | A. E. Goldfarb | Dec. 20, 1983 |

Of these patents, the '198 patent issued to Mayenschein discloses a novelty clock using an accumulation of balls displayed on a track to depict the current time. A plurality of balls is provided in a reserve portion of a track. A pivoting arm rotates at a rate of one rotation per minute. At a low point of the rotation, the arm picks up one of the balls and deposits it onto the upper end of the track when the arm reaches a high point in its rotation. The ball traverses the track until reaching the first time indicator, which is in one minute increments up to four minutes. When a fifth ball is deposited into the first time indicator, the first time indicator is emptied, with one ball being delivered to a second time indicator and the remainder being delivered back to the reserve. The second time indicator is in five minute increments up to fifty five minutes. The minutes are determined by combining the values of the last displayed balls in the first and second time displays. When both the first and second time indicators have been filled, the next ball deposited causes the first time indicator to dispense all of the balls therein, one being diverted to the second time indicator as described, that ball causing the second time indicator to be emptied, with one ball being directed toward a third time indicator and the remainder back to the reserve. The third time indicator is in one hour increments up to twelve hours. In like manner to the first and second time indicators, when twelve is displayed in the third time indicator and a further ball is delivered thereto, all of the balls are emptied and delivered to the reserve. Each of the time indicators is provided with one permanently placed ball in order to enable reorientation of the time indicator after having been emptied. In the first and second time indicators, this ball is positioned in a "zero" position, given no value. In the third time indicator, this ball is position in the "one" position.

The '211 patent issued to Mayenschein discloses a novel clock which visually indicates the current time by continuously changing the placement order of a plurality of accumulated balls. A plurality of apertures are defined by a housing, with each aperture representing a particular time increment. In one housing, the time increments are hours, in a second housing, the time increments are five minutes, and in a third housing the time increments are one minute. There are four apertures in the third housing. The first housing thus displays the hour while the second and third housings combine to display the minutes. A motor is provided in each housing to move the balls therein to display the balls through the appropriate aperture. Each housing is designed to resemble a train car, with the three being connected in end-to-end fashion behind a train engine to give the appearance of a train.

Hicks et al., in the '064 patent, disclose a clock which uses a counting device with ball actuated, aligned, rotatable indicating elements. The '064 device includes a plurality of indicating elements rotatable around parallel axes, arranged side by side in three columns, representing one hour increments, ten minute increments and one minute increments. Each indicating element includes a display portion and a ball actuated flange, mounted on a common axle with the flanges of adjacent elements in each column forming a ball conveying track. The elements are successively rotated to the upward display position by a ball whose continued presence atop an element's flange causes an appropriate rotation of that element. The balls are continuously recycled by a synchronous motor elevator which collects the balls at their lowest position and returns them to their highest position in communication with the ball conveying tracks. After all of the indicating elements in a column have been raised to their display position, the ball resets the first rotated element causing it to reset the adjacent elements. In this way the elements are returned to their downward position by a domino effect.

Finally, Goldfarb ('415) discloses a clock mechanism which displays the time by accumulations of counting tokens deposited within three generally vertical but zigzag-shaped channels. As in the previously described devices, the three channels represent one hour, ten minute and one minute increments. A synchronously driven belt carries projecting pins which push the tokens along a path from an enclosure near the bottom of the mechanism to positions above the channels, whence the tokens drop into the channels that are not full. When a particular channel is full, a token bypasses that channel and causes tokens already within the channel to be released for return to the enclosure. Time indicia disposed in front of the channels and the push-path identify the times represented by the various possible accumulations of tokens in the channels and the positions of tokens along the push-path. The indicia are adapted to be relatively inconspicuous when not backed up by tokens, and to be made relatively conspicuous when they are backed up by tokens.

BRIEF SUMMARY OF THE INVENTION

The present invention is a novelty clock having a display comprised of numbered balls. Specifically, the present invention is a clock in which replica pool balls are used to display the current time in a twelve hour cycle. The clock is contained primarily within a housing having a front panel defining a time display opening through which the balls are passed. The balls are displayed on a shelf that is hinged to the front panel of the clock. The shelf is pivoted upwardly to withdraw the balls and is then lowered to return the balls the most forward position. The housing is received within an opening in the wall of a structure making the only visible portions of the clock the front panel including the display, and whatever is visible through the time display opening in the front panel.

Three ball receiving carousels are provided. The first carousel defines ten ball receptacles for displaying one minute increments of time. A second carousel defines six ball receptacles and is provided for displaying ten minute increments. A third carousel defines twelve ball receptacles and is provided for displaying one hour increments. Each carousel includes first and second side walls mounted on either end of a bearing sleeve. The bearing sleeve is provided for receiving an axle. At least one end of the axle is carried by a mounting bracket secured to the clock housing.

A plurality of ball receiving cells are defined along the periphery of each carousel by an array of equally spaced apart dividing walls. In the first carousel, the dividing walls are spaced at a 36° angular spacing. In the second carousel, a 60° angular spacing is provided. In the third carousel, a 30° angular spacing is provided.

A ball support is provided for retaining the balls within their respective cells at least in the bottom half of the carousel. The ball support defines an arcuate track carried by the ball support over which the balls travel while in the bottom portion of the rotation.

One ball from each carousel is absent from its respective cell at any given time except during the changing of the time. Because the empty cell is disposed on the front side of the carousel, the weight of the remaining balls in that carousel serve to cause the carousel to rotate backwards until the empty cell is disposed at the top of the carousel. In order to prevent such backwards rotation, a stop is carried by the ball support. The stop is an elongated member pivotally connected at one end to the ball support. The stop is oriented such that the free end is disposed above the pivoted end and within a ball receiving cell. As the weight of the balls cause the carousel to experience reverse rotation, the free end of the stop engages a divider wall to stop rotation.

A time display control mechanism is provided for moving the first carousel through a rotation of 36° each minute. The mechanism includes primarily a timing device, a motor, and a drive mechanism. At one minute intervals, the timing device actuates the motor. The motor is mounted on a bottom panel of the housing and includes an output shaft to which the drive mechanism is connected. When the motor is actuated, the output shaft imparts movement in the drive mechanism, which in turn rotates the first carousel.

The drive mechanism includes a first pulley mounted on and rotated by the motor output shaft. A second pulley is mounted on an upper panel of the housing. A belt is received about each of the first and second pulleys in an endless configuration. The belt is secured to a planar grid that is slidably mounted on the inside wall of the front panel of the housing. As the motor is actuated, the belt is moved in a circuitous path, thus moving the grid vertically either up or down.

Initially, when the motor is actuated, the grid is moved upwardly. The drive mechanism further includes first and second limit switches to limit the movement of the grid in either direction. The first limit switch is provided at the upper limit of travel of the grid. The limit switch is positioned such that the grid engages the limit switch at the upper limit of travel. When engaged, the first limit switch signals the motor to reverse direction. The grid is then moved downward until it engages the second limit switch which signals the motor to deactivate.

In an alternate embodiment, a cam plate is mounted on the output shaft of the motor. A cam is eccentrically carried on the cam plate. The motor is oriented such that the cam is inserted into a slot formed in the grid. The motor is actuated through one complete rotation at each one minute interval. As the motor is actuated and the output shaft rotated through the first half of the cycle, the cam is raised, thus raising the grid. During the second half of the cycle, the cam, and consequently the grid, is lowered. The slot is so formed to allow lateral movement of the cam during the rotation of the motor output shaft.

In a further alternate embodiment, a digital processor is used to operate a step motor. In this embodiment, the timing device and limit switches are not necessary. The digital processor is used to signal the step motor how far to step in one direction before reversing direction. The digital processor then signals the step motor when to stop. In a further alternate embodiment the digital processor is used to control three step motors. One step motor is provided for imparting rotation on each carousel, thereby eliminating the need for engagement devices between each of the grid and first carousel, the first and second carousels, and the second and third carousels.

Changing the time display is accomplished through three primary steps. First, at least the one minute ball is withdrawn into the first carousel. Next, at least the first carousel is rotated through an increment equal to the angular length of its ball receiving cells. Finally, the new time display is moved to a viewing position. At the changing of a ten minute increment, the first step also includes withdrawing the ten minute ball, and the second step includes moving the second carousel through a rotation of 60°. Likewise, at the changing of a one hour increment, the one hour ball is also withdrawn and the third carousel is rotated through 30°.

In order to withdraw the balls, a lifting mechanism is provided for pivoting the shelf upward. As the shelf is pivoted such that its distal end is elevated above its proximal end, each of the balls is encouraged toward their respective ball receiving cells.

The second step of the time display change process is accomplished through a portion of the downward motion of the grid. A pivoting engagement member is carried by the grid and is positioned to engage one of an array of fixed engagement members carried by the first carousel. A biasing device is provided for biasing the pivoting engagement member toward the first carousel such that as the grid begins its descent, the pivoting engagement member engages the fixed engagement member, thus imparting downward rotation on the first carousel. As the first carousel begins rotating, the one minute ball is received within its ball receiving cell. As the first carousel continues to be rotated downwardly, the next successive ball receiving cell is aligned with the time display opening defined by the front panel.

While the grid descends from its upper limit to its lower limit, the shelf is lowered in a reverse manner to that described for its raising. Thus, when the ball receiving cells are in substantial alignment with the time display opening and the shelf is oriented such that its distal end is lower than its proximal, each of the one minute, ten minute and one hour balls are rolled to the distal end of the shelf into a display position.

At the passing of each ten minute interval, the rotation of both the first and second carousel to change the one minute ball and ten minute ball, respectively, is required. To impart rotation on the second carousel, an array of six fixed engagement members are carried on the exterior of the second carousel first wall. A pivoting engagement member that is normally not biased toward the second carousel is provided. A biasing device including a first magnet carried by the first carousel and a second magnet carried by the pivoting engagement member is provided for biasing the pivoting engagement member toward the second carousel once during each revolution of the first carousel.

At the passing of each one hour increment, rotation is imparted on the third carousel by the second carousel in similar fashion to the manner in which rotation is imparted on the second carousel by the first carousel.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

Figure 1:
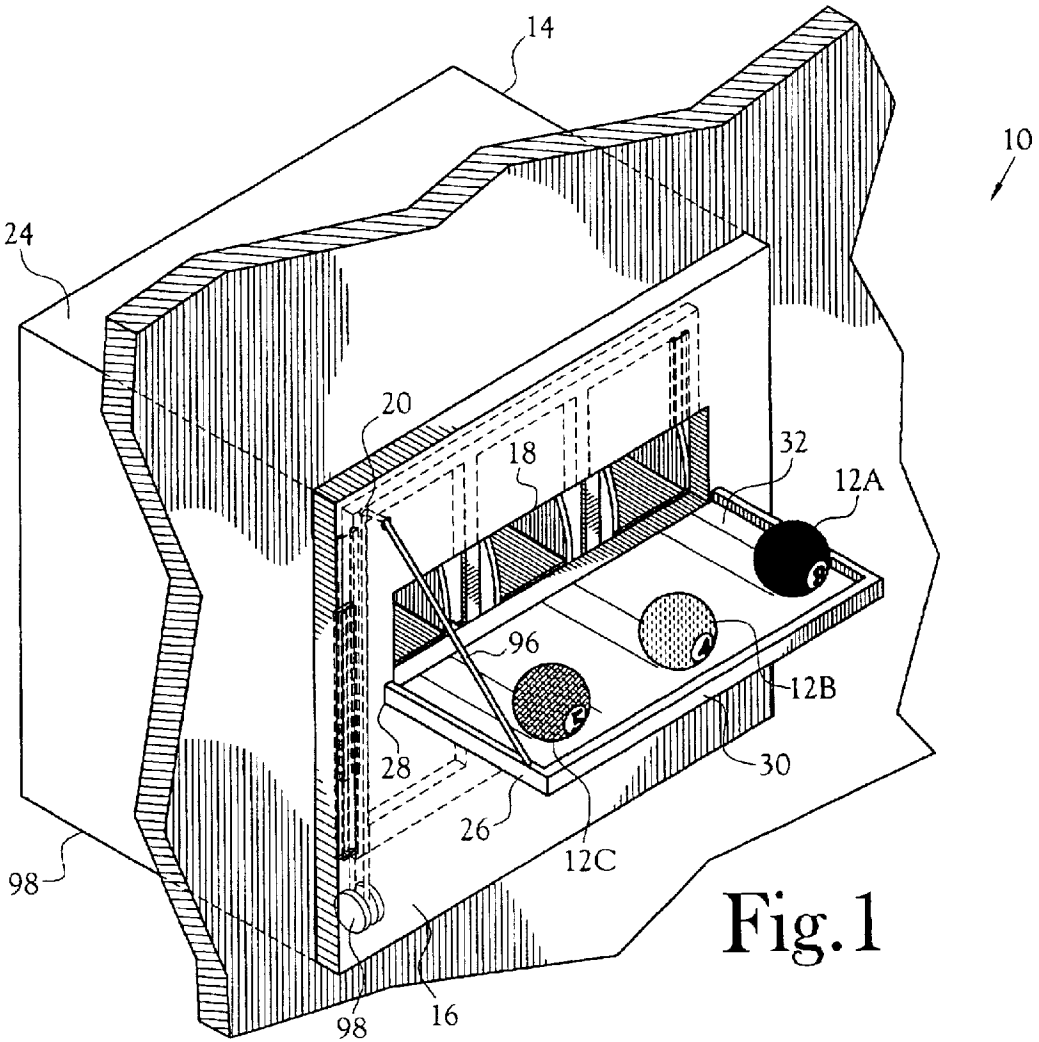
FIG. 1 is a perspective illustration of novelty clock of the present invention.

A novelty clock having a display comprised of numbered balls is illustrated at 10 in the figures. Specifically, the present invention is a clock 10 in which replica pool balls 12 are used to display the current time. In the illustrated embodiment, the time is displayed in a twelve hour cycle. Illustrated in FIG. 1 is a generic display of the time using the present invention. The display reads 5:48 with no indication of morning or afternoon. After the passing of one minute, the eight ball will be withdrawn and a nine ball will be displayed. After the passing of another minute, the four and nine balls will both be replaced with a five ball and a cue ball, respectively, the cue ball representing zero. Likewise, at the appropriate time, the hour will change as well.

The clock 10 is contained primarily within a housing 14 having a front panel 16 defining a time display opening 18 through which the balls 12 are passed. The balls 12 are displayed on a shelf 26 that is hinged to the front panel 16 of the clock 10. The shelf 26 is pivoted upwardly to withdraw the balls 12 and is then lowered to return the balls 12 the most forward position. A track 32 is provided in the shelf 26 for each of the balls 12 in order to control the path followed by each ball 12 and to ensure the return of each ball 12 to the appropriate carousel 34. Because the balls 12 will not always be oriented such that the numbers are easily readable, the color and pattern of each ball 12 is used to determine the displayed time, which is a simple task for those familiar with the color scheme of conventional pool balls. In the illustrated embodiment, the housing 14 is received within an opening in the wall of a structure. Thus, the only visible portions of the clock are the front panel 16 including the shelf 26, three balls 12A,12B,12C and whatever is visible through the time display opening 18 in the front panel 16. However, other embodiments are anticipated in which the internal portions of the clock 10 are visible. For example, a desktop style clock having a transparent housing is anticipated, with the movement of the internal parts of the clock providing entertainment.

Figure 2:
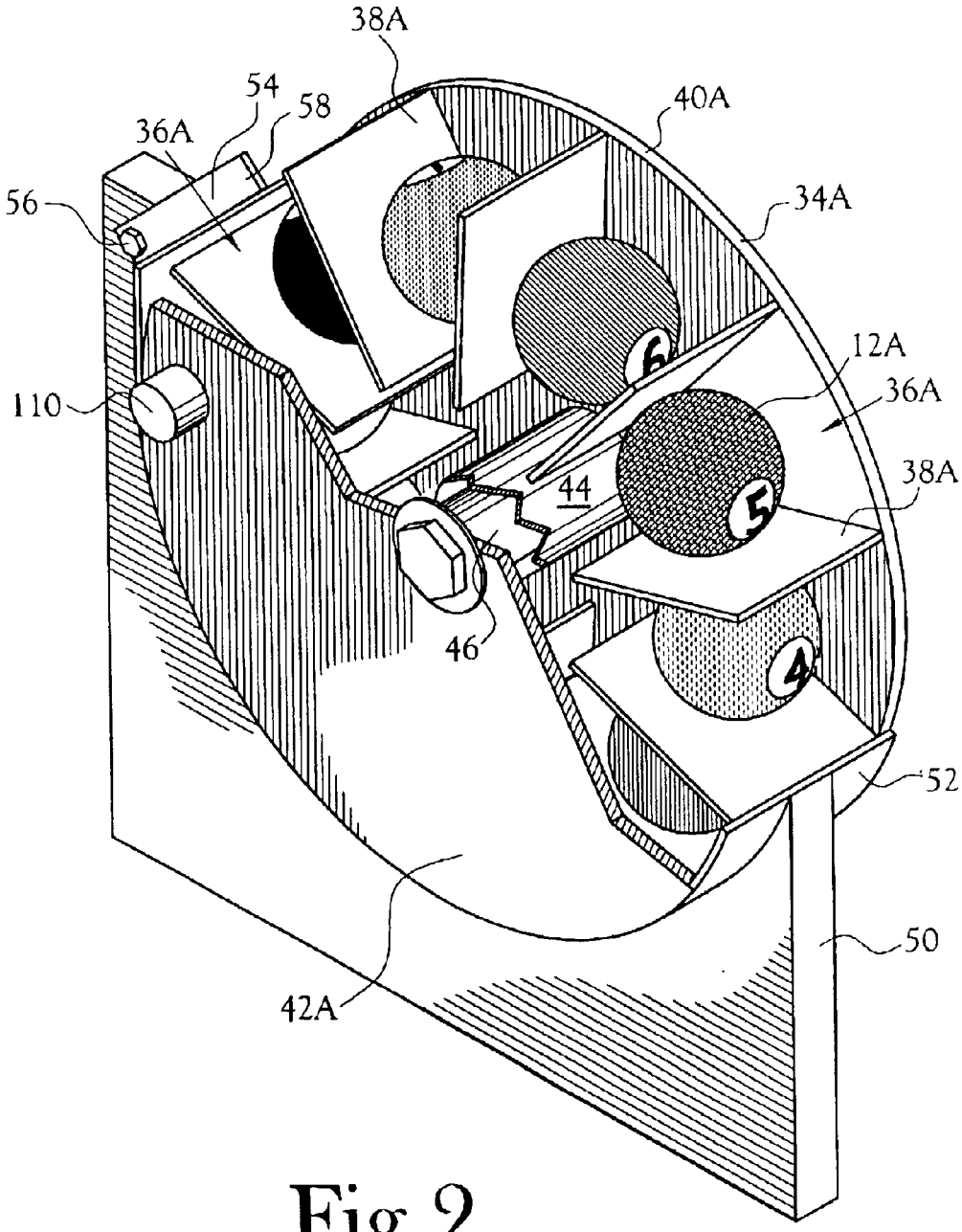
FIG. 2 is a perspective view, partially in section, of a typical ball carousel incorporated in the novelty clock of the present invention.

Three ball receiving carousels 34A,34B,34C are provided. The first carousel 34A, illustrated more clearly in FIG. 2, defines ten ball receiving cells 36A, or receptacles for displaying one minute increments of time. A second carousel 34B defines six ball receptacles 36B and is provided for displaying ten minute increments. Finally, a third carousel 34C defines twelve ball receptacles 36C and is provided for displaying one hour increments. Although the first carousel 34A is illustrated in detail, each of the second and third carousels 34B,34C are similar in construction. The first carousel 34A includes first and second side walls 40,42 mounted on either end of a hub 44. The hub 44 is provided for receiving an axle 46. At least one end of the axle 46 is carried by a mounting bracket 48 secured to the clock housing 14.

A plurality of ball receiving cells 36 are defined along the periphery of the carousel 34 by an array of dividing walls 38. The dividing walls 38 of the array are equally spaced apart. In the first carousel 34A, the dividing walls 38A are spaced at a 36° angular spacing. In the second carousel 34B, a 60° angular spacing is provided between the dividing walls 38B. In the third carousel 34C, a 30° angular spacing is provided between the dividing walls 38C.

A ball support 50 is provided for retaining the balls 12 within their respective cells 36 at least in the bottom half of the carousel 34. The ball support 50 defines an arcuate surface over which the balls travel while in the bottom portion of the rotation. In the illustrated embodiment, an arcuate track 52 is carried by the ball support 50, the arcuate track 52 extending substantially between the first and second side walls 40,42.

One ball 12 from each carousel 34 is absent from its respective cell 36 at any given time except during the changing of the time. Because the empty cell 36 is disposed on the front side of the carousel 34, the weight of the remaining balls 12 in that carousel 34 serve to cause the carousel 34 to rotate backwards until the empty cell 36 is disposed at the top of the carousel 34. In order to prevent such backward rotation, a stop 54 is carried by the ball support 50. In the illustrated embodiment, the stop 54 is an elongated member pivotally connected at one end 56 to the ball support 50. The stop 54 is oriented such that the free end 58 is disposed above the pivoted end 56 and within a ball receiving cell 36. As the weight of the balls 12 cause the carousel 34 to experience reverse rotation, the free end 58 of the stop 54 engages a divider wall 38 to stop rotation.

Figure 3:
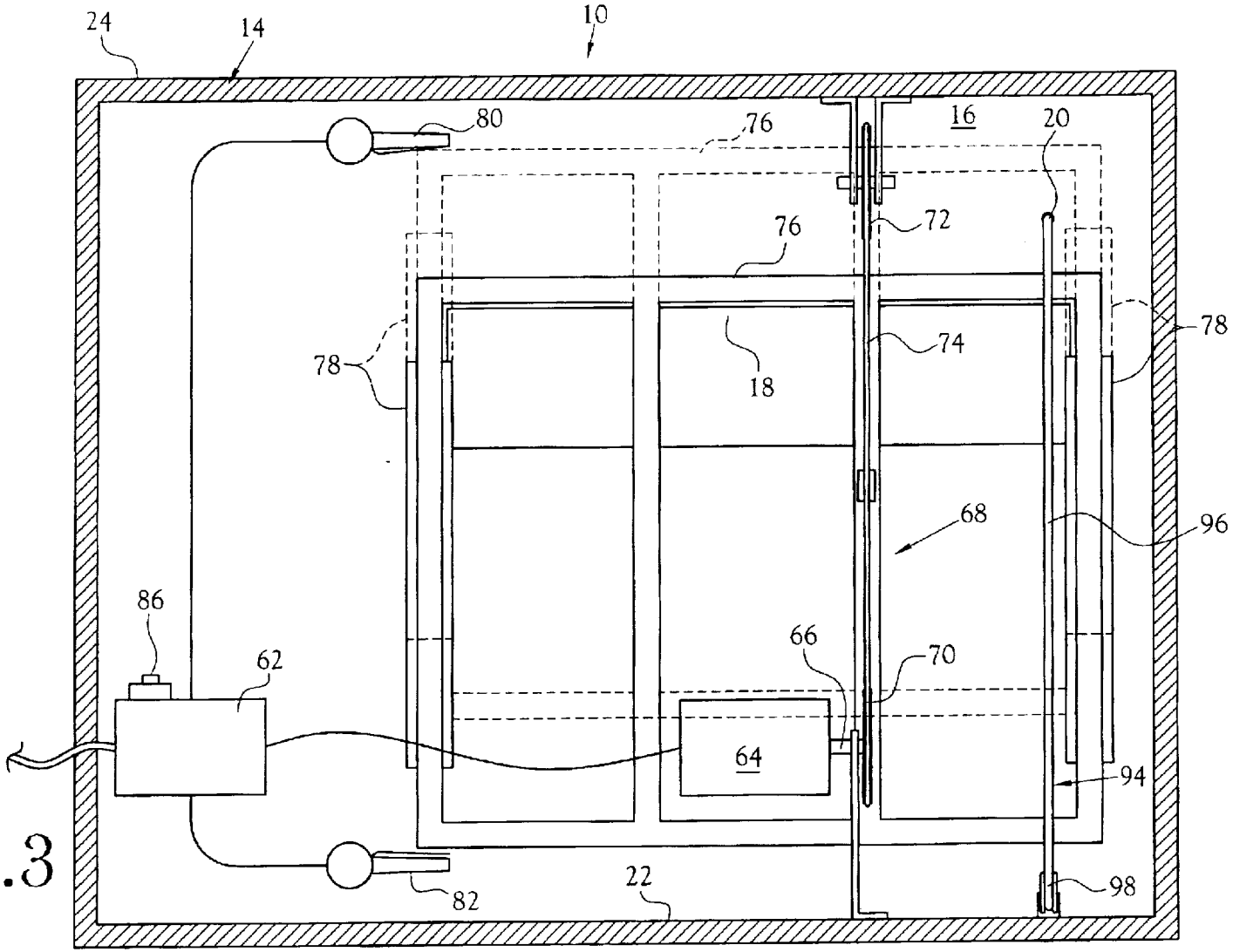
FIG. 3 is a front elevation view, in section, of the novelty clock of the present invention taken along lines 3—3 of FIG. 1.

Illustrated in FIG. 3 is a time display control mechanism 60. The mechanism 60 is provided for moving the first carousel 34A through a rotation of 36° each minute. As will be discussed below, with every tenth movement of the first carousel 34A, a pivoting engagement member 106 carried by the grid 76 and actuated by a magnet 110 carried by the first carousel 34A moves the second carousel 34B through a rotation of 60°. Similarly, with every six movements of the second carousel 34B, a further pivoting engagement member 106 carried by the grid 76 and actuated by a magnet 110 carried by the second carousel 34B moves the third carousel 34C through a rotation of 30°. The mechanism 60 includes primarily a timing device 62, a motor 64, and a drive mechanism 68. At one minute intervals, the timing device 62 actuates the motor 64. The motor 64 is mounted on a bottom panel 22 of the housing 14 and includes an output shaft 66 to which the drive mechanism 68 is connected. When the motor 64 is actuated, the output shaft 66 imparts movement in the drive mechanism 68, which in turn rotates the first carousel 34A.

The drive mechanism 68 of the illustrated embodiment includes a first pulley 70 mounted on and rotated by the motor output shaft 66. A second pulley 72 is mounted on an upper panel 24 of the housing 14. A belt 74 is received about each of the first and second pulleys 70,72 in an endless configuration. The belt 74 is secured to a planar grid 76 that is slidably mounted on the inside wall of the front panel 16 of the housing 14. In the illustrated embodiment, a slide mount 78 is provided on each side of the grid 76. As the motor 64 is actuated, the belt 74 is moved in a circuitous path, thus moving the grid 76 vertically either up or down.

Initially, when the motor 64 is actuated, the grid 76 is moved upwardly. The drive mechanism 68 further includes first and second limit switches 80,82 to limit the movement of the grid 76 in either direction. The first limit switch 80 is provided at the upper limit of travel of the grid 76. The first limit switch 80 is positioned such that it is engaged by the grid 76 at the upper limit of travel. When engaged, the first limit switch 80 signals the motor 64 to reverse direction. At this point, the grid 76 is moved downward until it engages the second limit switch 82. The second limit switch 82 signals the motor 64 to deactivate.

Figure 4:
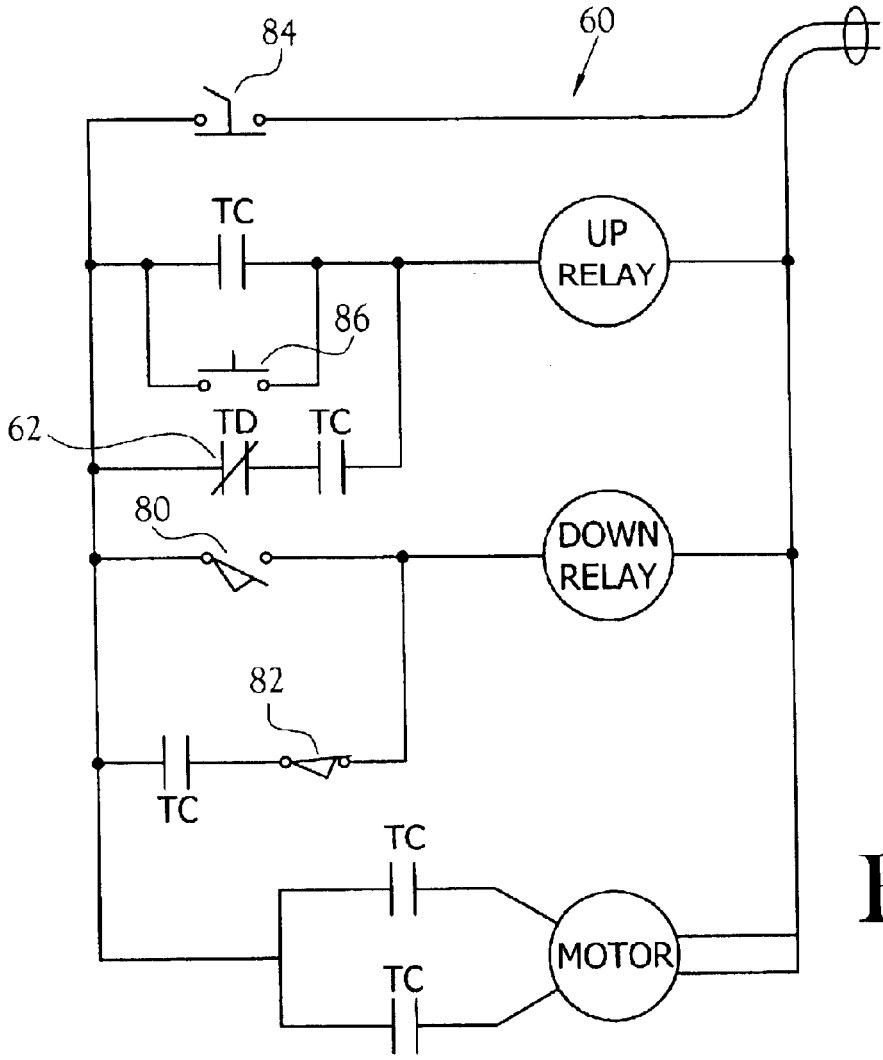
FIG. 4 is a circuit diagram of the embodiment illustrated in FIG. 1 of the novelty clock of the present invention.

FIG. 4 illustrates a circuit diagram of the electronics associated with the present invention. A switch 84 is provided for turning the clock ON and OFF. In order to activate the motor 64, either of a timing device 62 such as an electronic circuit or a mechanical switch 86 is used. During normal operation, the electronic circuit 62 is used to measure one minute increments and signal the motor 64 to actuate. For purposes of testing and/or setting the time display, the mechanical switch 86 is used. The mechanical switch 86 precludes the user from waiting up to a full minute in order to advance the clock display one minute.

Figure 7:
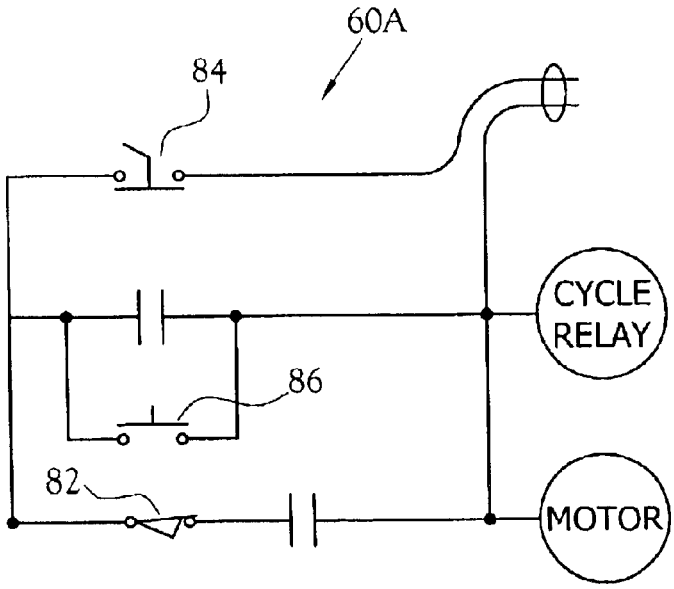
FIG. 7 is a circuit diagram of the alternate embodiment of the present invention illustrated in FIG. 5.
Figure 5:
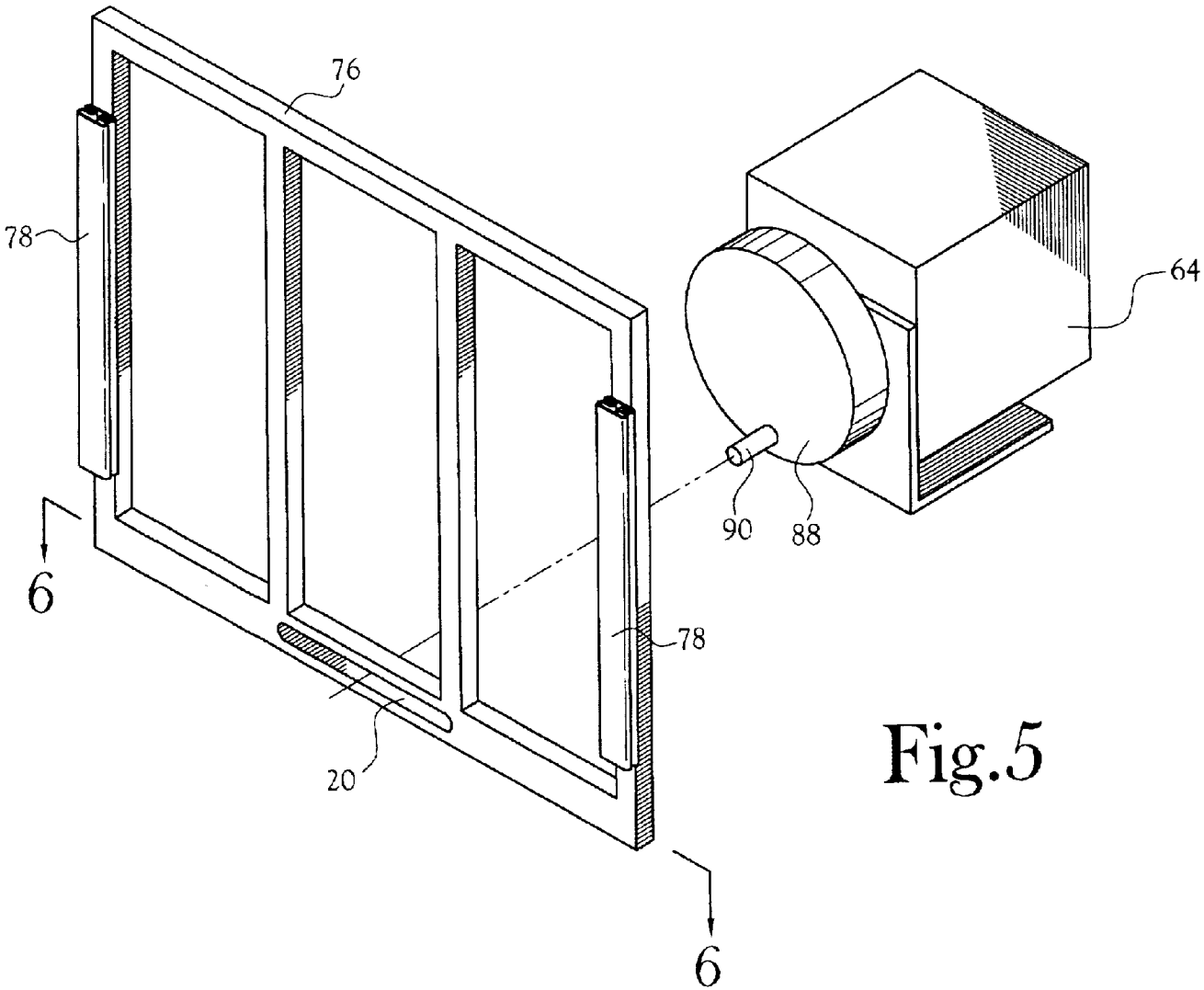
FIG. 5 is a perspective view, showing partially exploded, of an alternate embodiment of the novelty clock of the present invention.
Figure 6:
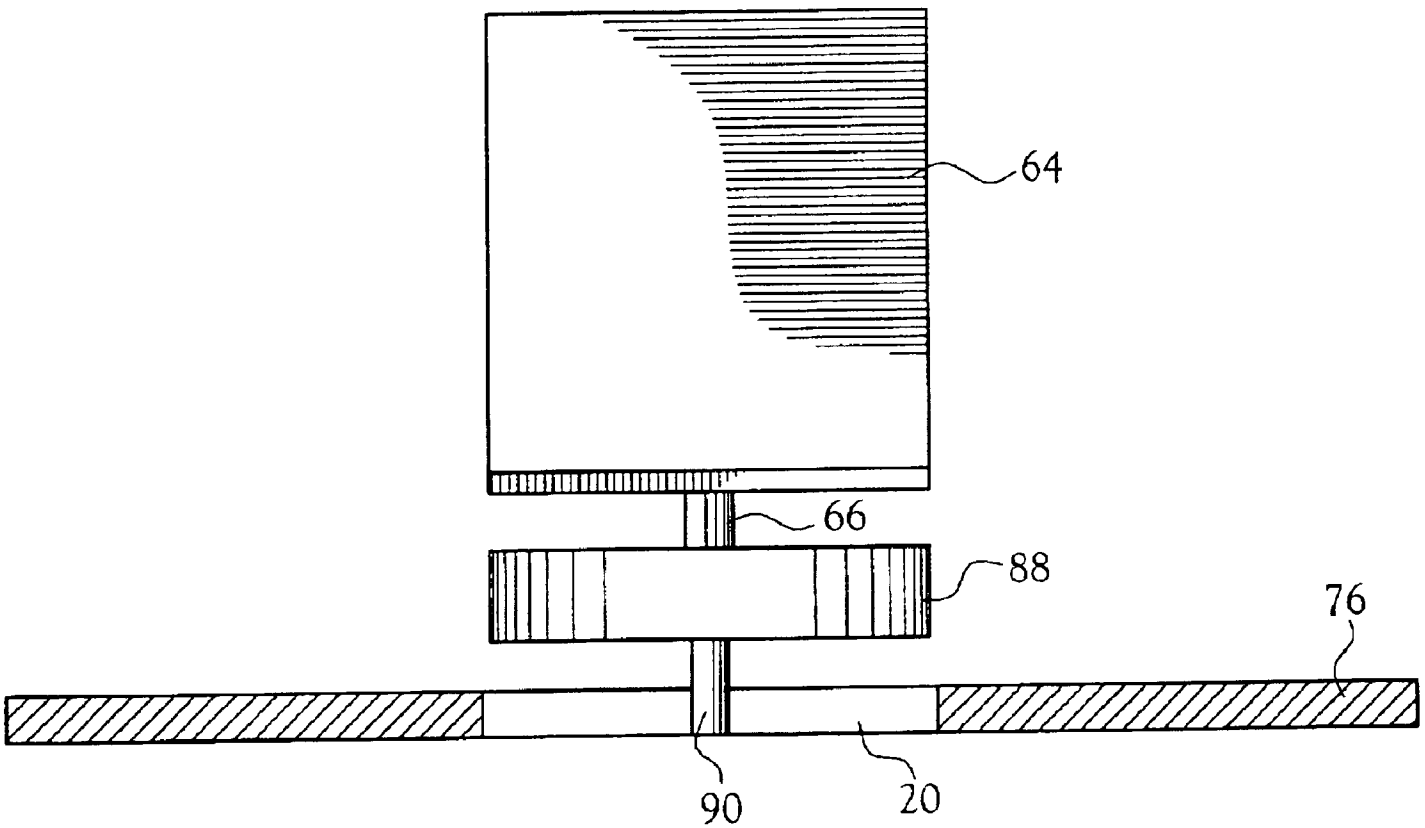
FIG. 6 is a top plan view, in section, of the alternate embodiment of the novelty clock of the present invention taken along lines 6—6 of FIG. 5.

In an alternate embodiment illustrated in FIGS. 5 and 6, a cam plate 88 is mounted on the output shaft 66 of the motor 64. A cam 90 is eccentrically carried on the cam plate 88. The motor 64 is oriented such that the cam 90 is inserted into a slot 92 formed in the grid 76. In this embodiment, the motor 64 is actuated through one complete rotation at each one minute interval. As the motor 64 is actuated and the output shaft 66 rotated through the first half of the cycle, the cam 90 is raised, thus raising the grid 76. During the second half of the cycle, the cam 90, and consequently the grid 76, is lowered. The slot 92 is so formed to allow lateral movement of the cam 90 during the rotation of the motor output shaft 66. Because the upper and lower limits of travel are dictated by the eccentricity of the cam 90, the upper limit switch 80 is not necessary. The lower limit switch 82 is used in this embodiment to deactivate the motor 64 at the completion of one revolution. FIG. 7 illustrates a circuit diagram of the electronics associated with the alternate embodiment of FIGS. 5 and 6.

In a further alternate embodiment not illustrated, a digital processor is used to operate at least one step motor. In this embodiment, the timing device and limit switches are not necessary. The digital processor is used to signal the step motor how far to step in one direction before reversing direction. The digital processor then signals the step motor when to stop. In one embodiment using a digital processor, the processor is used to control three step motors. One step motor is used to rotate each carousel 34A,34B,34B. At the passing of each one minute interval, the first step motor steps the first carousel 34A through a rotation of 36°. At the passing of each ten minute interval, the second step motor steps the second carousel 34B through a rotation of 60°. Likewise, at the passing of each one hour interval, the third step motor steps the third carousel 34C through a rotation of 30°. In this embodiment, the engagement members between the grid 76 and the first carousel 34A, the first and second carousels 34A,34B, and the second and third carousels 34B,34C, (described in more detail below) are not required.

Figure 8A:
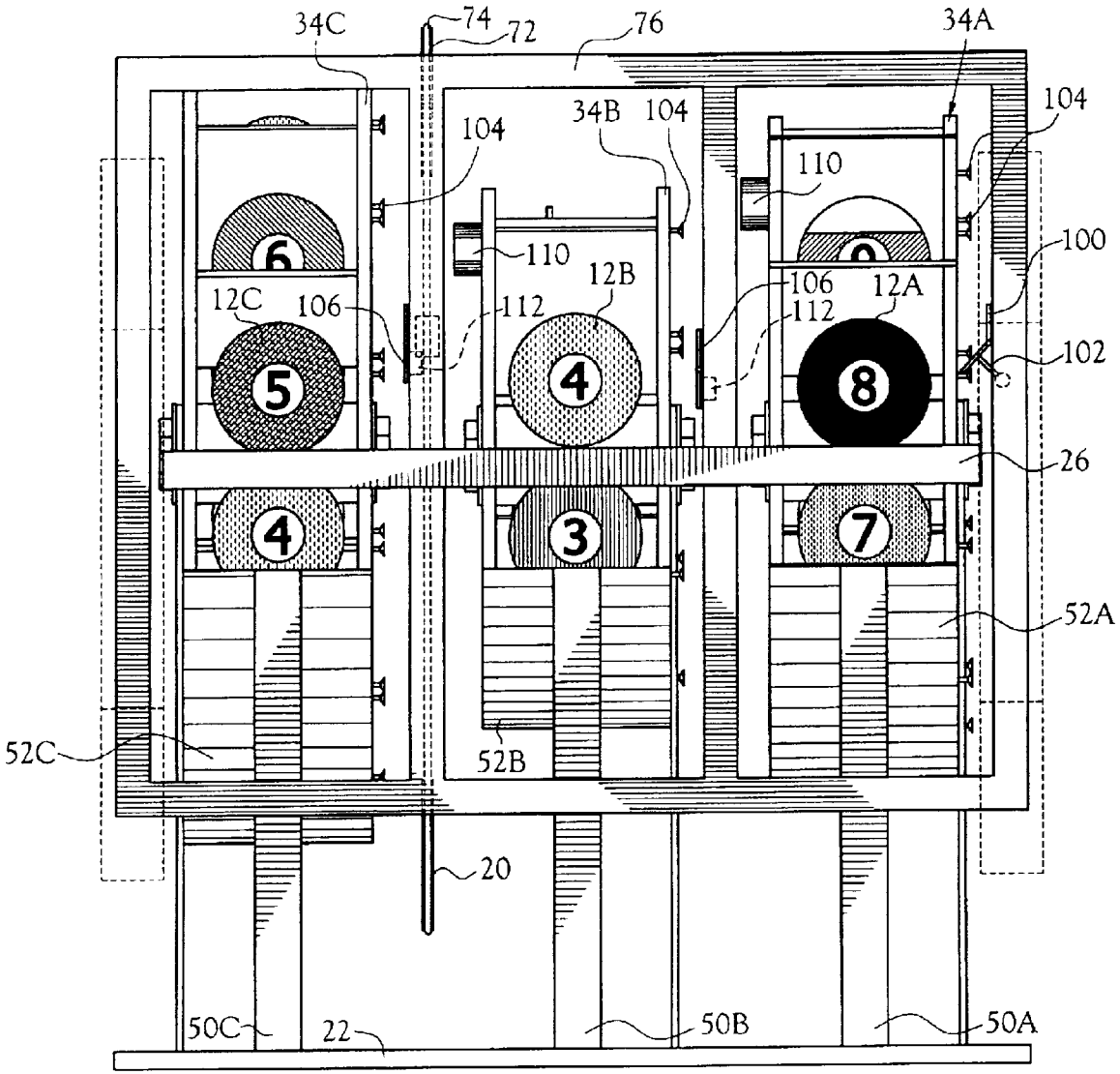
FIG. 8A is a front elevation view of a portion of the novelty clock of the present invention illustrating the uppermost movement of the grid at which point the motor is reversed, with the first carousel pivoting engagement member engaged with a first carousel fixed engagement member to impart rotation on the first carousel to advance the time one minute.
Figure 8B:
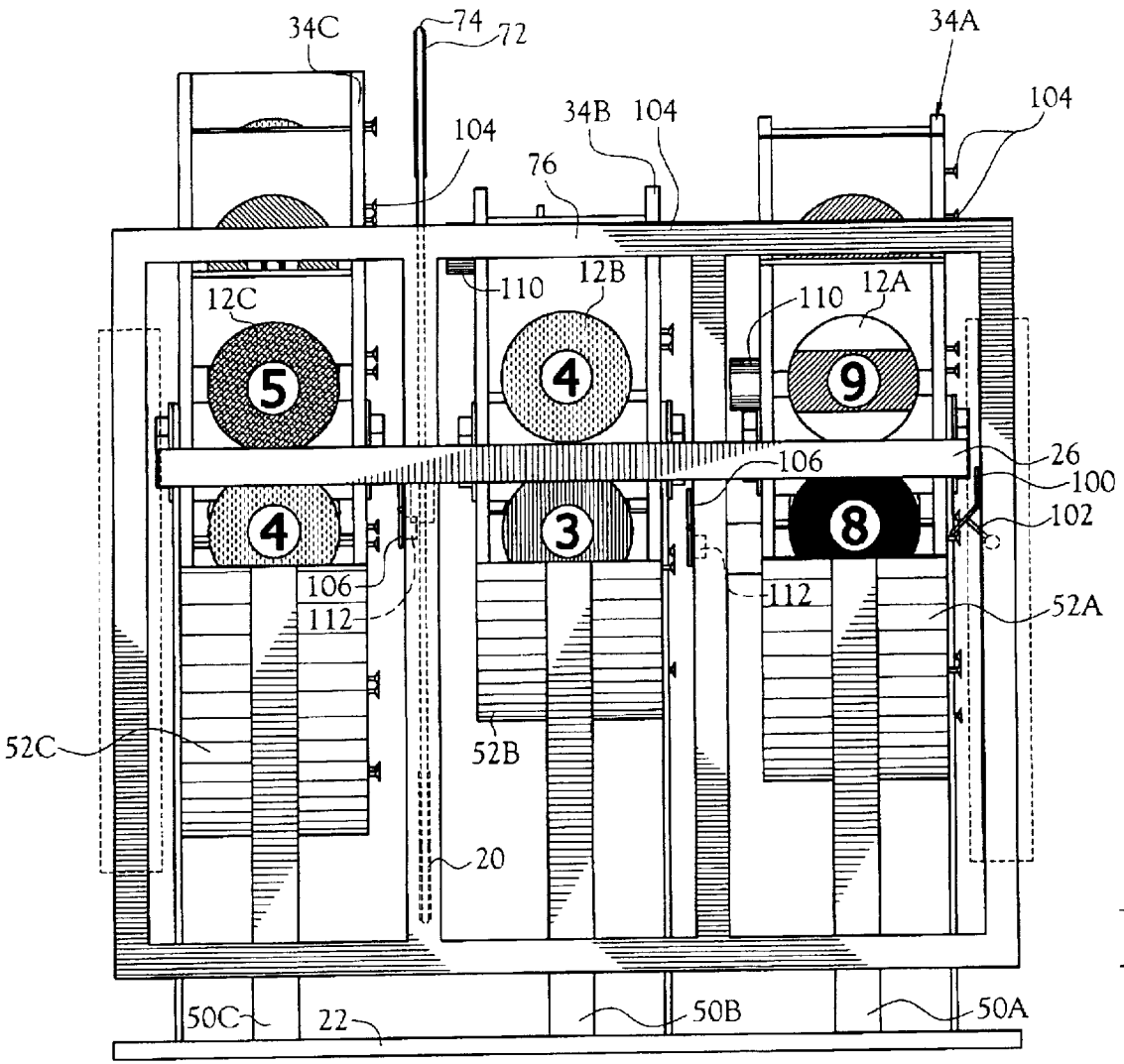
FIG. 8B illustrates the end of the time change initiated in FIG. 8B wherein the grid has reached its lowermost travel and the motor has been deactuated.

FIGS. 8A and 8B depict the manner in which the first carousel 34A is rotated in order to change the time from 5:48 to 5:49, requiring only the rotation of the first carousel 34A. Changing the time display is accomplished through three primary steps. First, at least the one minute ball 12A is withdrawn into the first carousel 34A. Next, at least the first carousel 34A is rotated through an increment equal to the angular length of its ball receiving cells 36A. Finally, the new time display is moved to a viewing position. At the changing of a ten minute increment, the first step also includes withdrawing the ten minute ball 12B, and the second step includes moving the second carousel 34B through a rotation of 60°. Likewise, at the changing of a one hour increment, the one hour ball 12C is also withdrawn and the third carousel 34C is rotated through 30°.

In order to withdraw one or more of the one minute, ten minute and one hour balls 12A,12B,12C, a lifting mechanism 94 is provided for pivoting the shelf 26 upward. As the shelf 26 is pivoted such that its distal end 30 is elevated above its proximal end 28, each of the one minute, ten minute and one hour balls 12A,12B,12C is encouraged toward their respective ball receiving cells 36A,36B,36C. The illustrated lifting mechanism 94 includes a cable 96 connected at one end to the shelf 26 proximate the distal edge 30 thereof. The cable 96 is received through an opening 20 in the front panel 16 of the housing 14, around a pulley 98 carried below the grid 76, and is secured at its opposite end to the lower portion of the grid 76. Thus, as the grid 76 is raised, the cable 96 is pulled around the pulley 98 and through the opening 20 in order to lift the shelf 26 upward. It will be understood that even though this particular lifting mechanism 94 has been illustrated and described, other lifting mechanisms may be substituted with equal results. The first step is thus accomplished through the first half of the motor cycle.

Figure 9:
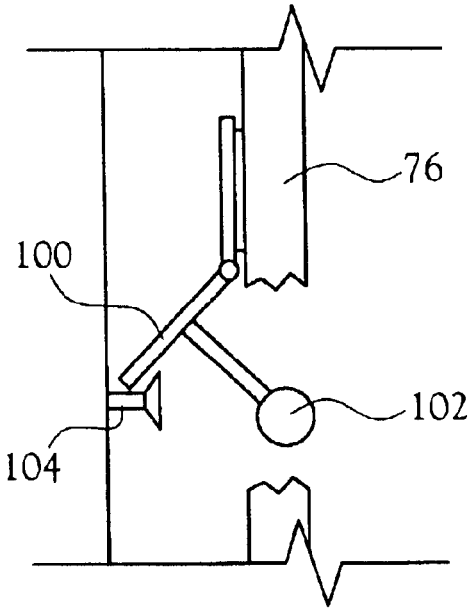
FIG. 9 is an enlarged view of the pivoting engagement member and a fixed engagement member of the first carousel.

The second step of the time display change process is accomplished through a portion of the downward motion of the grid 76. In the illustrated embodiment, a pivoting engagement member 100 is carried by the grid 76 and is positioned to engage one of an array of fixed engagement members 104 carried by the first carousel 34A. Specifically, ten fixed engagement members 104 are disposed in a circular array on the exterior surface of the first side wall 40A. The pivoting engagement member 100 is positioned such that as the grid 76 is raised to its uppermost limit, the pivoting engagement member 100 is passed over one of the fixed engagement members 104. A biasing device 102 is provided for biasing the pivoting engagement member 100 toward the first carousel 34A such that as the grid 76 begins its descent, the pivoting engagement member 100 engages the fixed engagement member 104, thus imparting downward rotation on the first carousel 34A. As most clearly illustrated in FIG. 9, the biasing device 102 is a weight attached to the pivoting engagement member 100, the weight being selected and positioned in such a manner as to normally bias the pivoting engagement member 100 toward the first carousel 24A. As the first carousel 34A begins rotating, the one minute ball 12A is received within its ball receiving cell 36A. As the first carousel 34A continues to be rotated downwardly, the next successive ball receiving cell 36A is aligned with the time display opening 18 defined by the housing front panel 16.

While the grid 76 descends from its upper limit to its lower limit, the shelf 26 is lowered in a reverse manner to that described for its raising. Thus, when the ball receiving cells 36 are in substantial alignment with the time display opening 18 and the shelf 26 is oriented such that its distal end 30 is lower than its proximal end 28, each of the one minute, ten minute and one hour balls 12A,12B,12C are rolled to the distal end 30 of the shelf 26 into a display position.

Figure 10A:
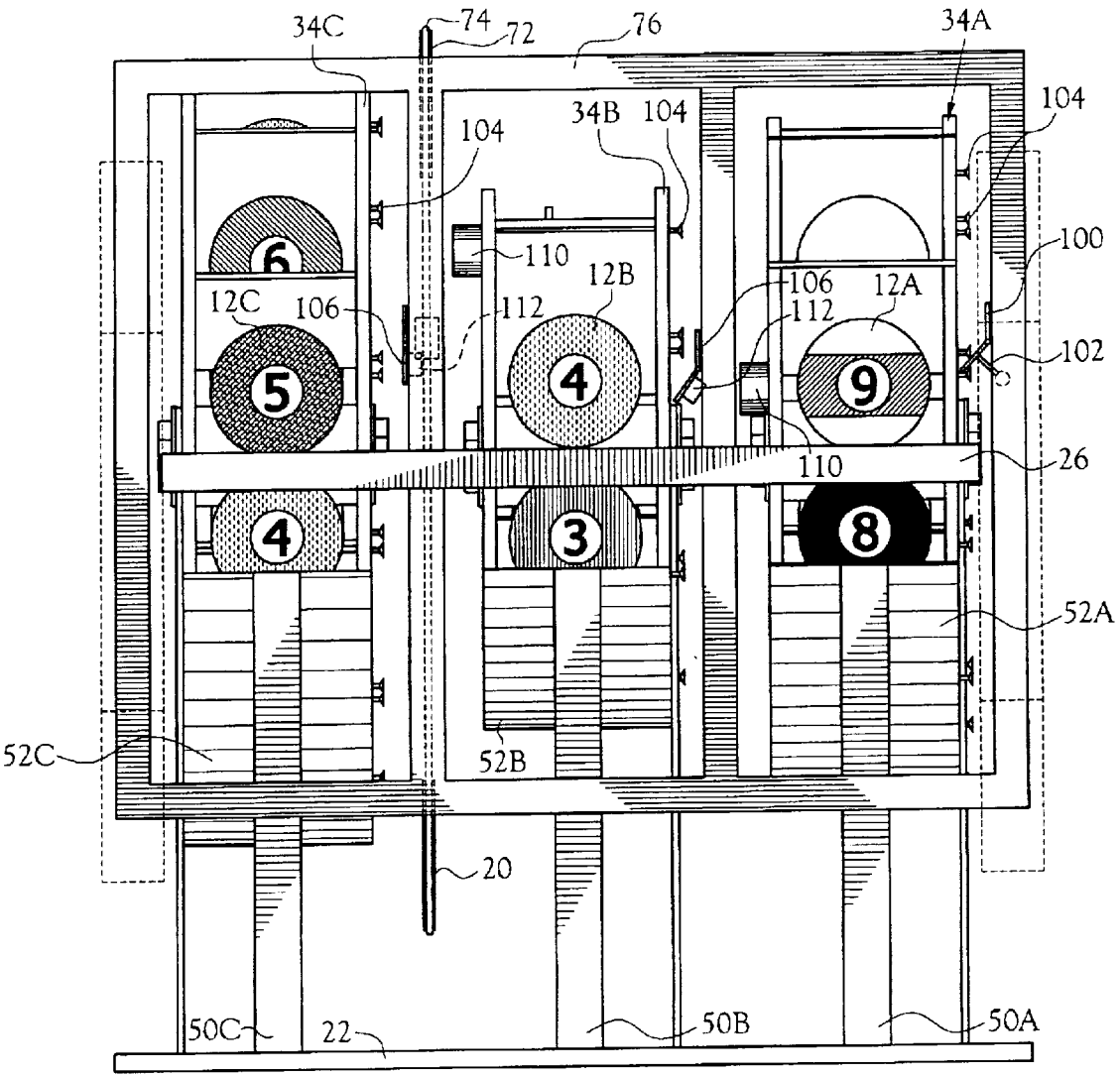
FIGS. 10A and 10B illustrate in similar fashion to FIGS. 8A and 8B the changing of the time display, with the one minute interval being reset from "9" to "0" and the ten minute interval being advanced an increment of one.
Figure 10B:
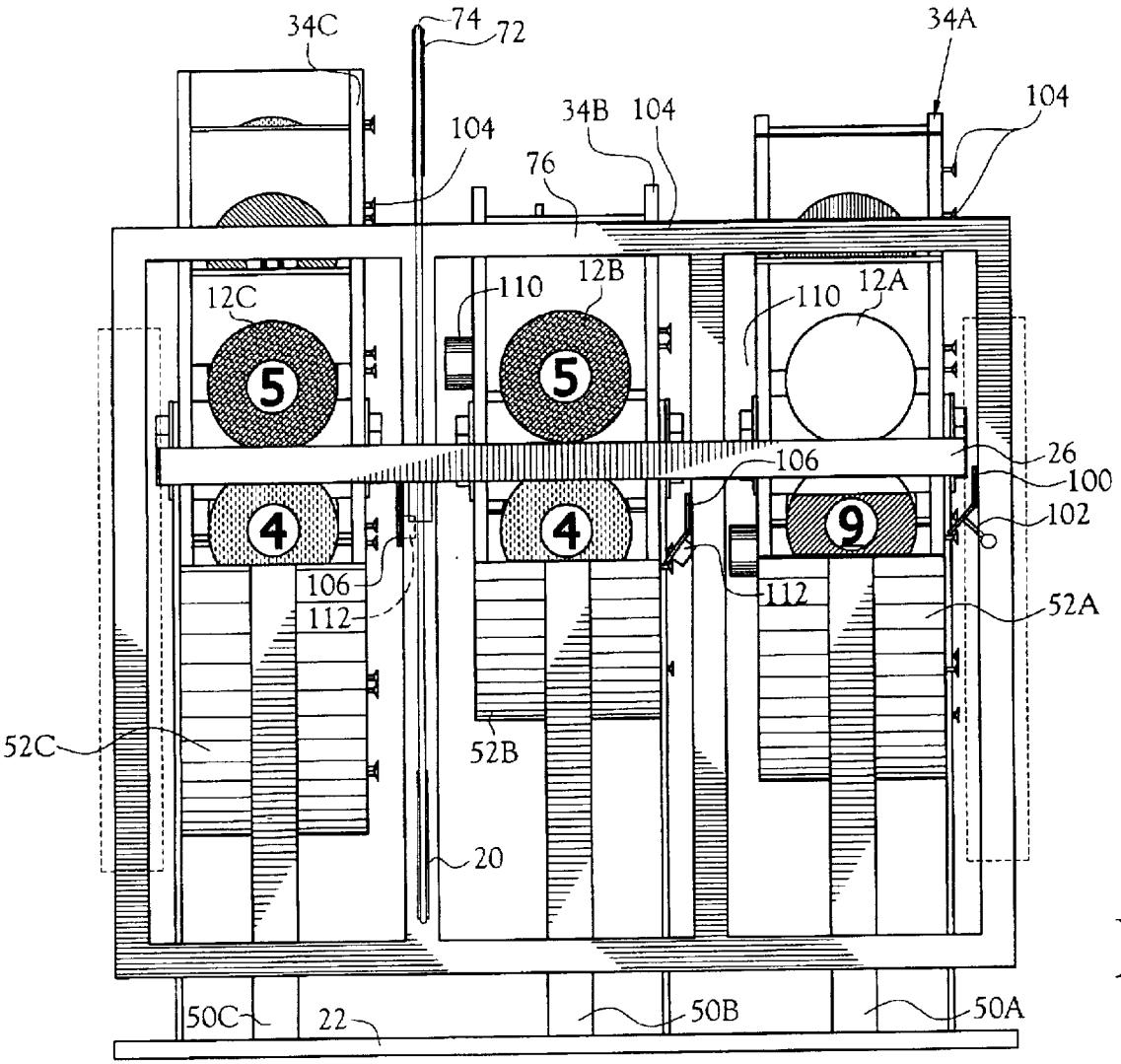

FIGS. 10A and 10B illustrate the time change from 5:49 to 5:50, requiring the rotation of both the first and second carousel 34A,34B to change the one minute ball 12A and ten minute ball 12B, respectively. The first carousel 34A is rotated as described above. To impart rotation on the second carousel 34B, an array of six fixed engagement members 104 are carried on the exterior of the second carousel first wall 40B, in similar manner to those of the first carousel 34A. However, with the second carousel 34B, it is not desirable to impart rotation with the passing of each minute. Accordingly, a pivoting engagement member 106 that is normally not biased toward the second carousel 34B is provided.

Figure 11:
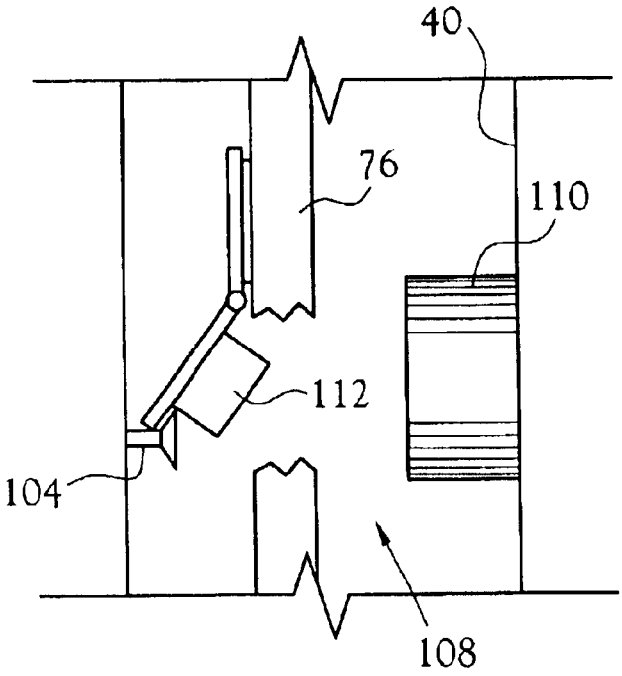
FIG. 11 is an enlarged view of the pivoting engagement member and a fixed engagement member of each of the second and third carousels.

A biasing device 108, best illustrated in FIG. 11, is provided for biasing the pivoting engagement member 106 toward the second carousel 34B once during each revolution of the first carousel 34A. In the illustrated embodiment, the biasing device 108 includes a first magnet 110 carried on the outer surface of the second wall 42A of the first carousel 34A and a second magnet 112 disposed on the outer surface of the pivoting engagement member 106. The first and second magnets 110,112 are oriented such that the first magnet 110 repels the second magnet 112, thus biasing the pivoting engagement member 106 toward the second carousel 34B. Once the pivoting engagement member 106 engages the fixed engagement member 104, the magnetic field between the first and second magnets 110,112 becomes irrelevant.

Figure 12A:
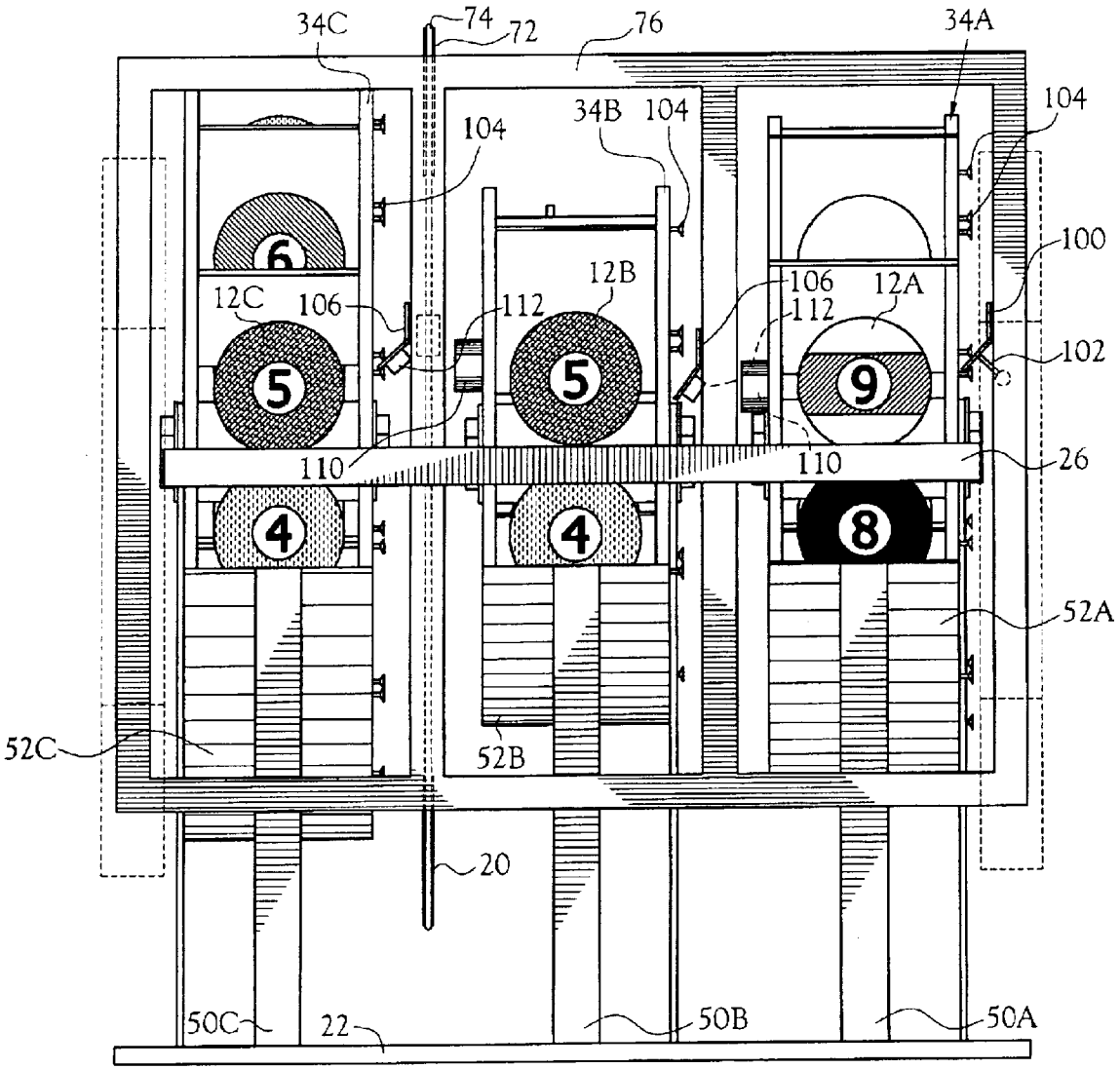
FIGS. 12A and 12B illustrate in similar fashion to FIGS. 10A and 10B the changing of the time display, with the ten minute interval being reset from "5" to "0" and the one hour interval being advanced an increment of one.
Figure 12B:
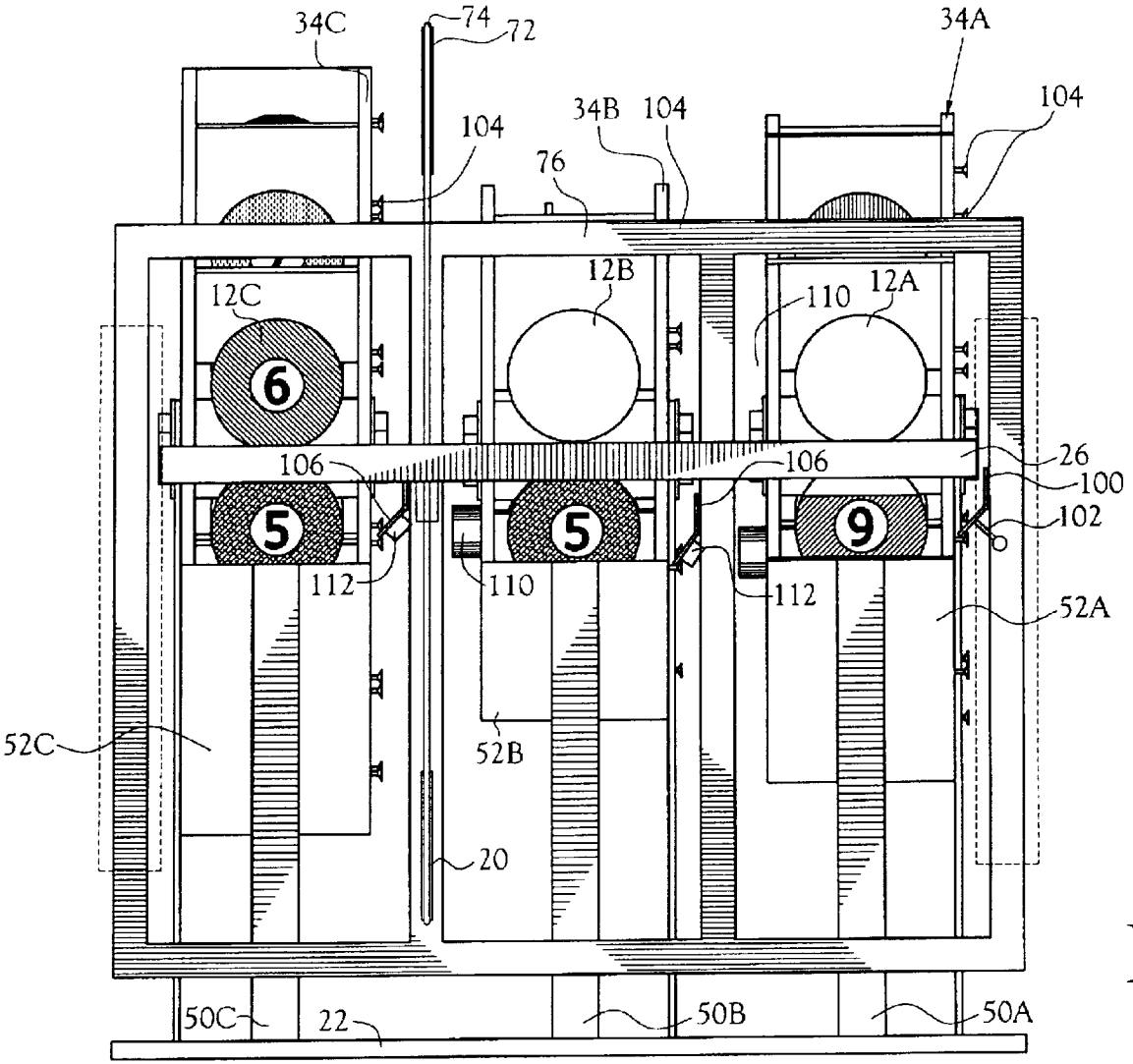

Finally, FIGS. 12A and 12B illustrate the time change from 5:59 to 6:00. Rotation is imparted on the third carousel 34C by the second carousel 34B in similar fashion to the manner in which rotation is imparted on the second carousel 34B by the first carousel 34A. Specifically, a pivoting engagement member 106 is carried by the grid 76 and is provided with a second magnet 112. A first magnet 110 is carried on the outer surface of the second wall 42B of the second carousel 36B. An array of twelve fixed engagement members 104 are disposed on the outer surface of the first wall 40C of the third carousel 34C. The strength and position of each of the first magnets 110 carried by the second and third carousels 36B,36C, as well as the strength of each of the second magnets 112, are selected such that only the associated second magnet 112 is repelled in order to engage the associated pivoting engagement member 106 with a fixed engagement member 104. Specifically, when the first magnet 110 carried by the first carousel 36A is rotated to a position to repel the second magnet 112 carried by the pivoting engagement member 106 associated with the second carousel 36B, the second magnet 112 carried by the pivoting engagement member 106 associated with the third carousel 36C is not also repelled.

From the foregoing description, it will be recognized by those skilled in the art that a novelty clock has been disclosed. The novelty clock disclosed provides a means for displaying the current time using numbered balls such as those simulating pool balls. The time display includes three balls representing one hour increments, ten minute increments, and one minute increments. For example, a display of a 5 ball, a 4 ball and an 8 ball indicates the current time as being 5:48. At the passing of each minute, at least the one minute ball is exchanged for the next successively-numbered ball. At the change of each ten minute ball, the one minute ball is reset to zero, represented in the illustrated embodiment by the cue ball. At the change of each one hour ball, both the ten minute and the one minute balls are reset to zero.

While the present invention has been illustrated by description of several embodiments and while the illustrative embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of the general inventive concept.

Having thus described the aforementioned invention, I claim:

1. A novelty clock comprising:

a housing having at least a front panel defining a time display opening;

a display shelf carried by said front panel below said time display opening; and a time display including a first numbered ball representing a one minute increment, a second numbered ball representing a ten minute increment, and a third numbered ball representing a one hour increment, said first numbered ball, said second numbered ball and said third numbered ball each being displayed on said display shelf.

2. The novelty clock of claim 1 further comprising:

a first carousel defining an array of ten ball receiving cells for receiving ten numbered balls representing zero through nine for use as said first numbered ball;

a second carousel defining an array of six ball receiving cells for receiving six numbered balls representing zero through five for use as said second numbered ball; and a third carousel defining an array of twelve ball receiving cells for receiving twelve numbered balls representing one through twelve for use as said third numbered ball.

3. The novelty clock of claim 2 further including a time display control mechanism for moving said first carousel through a rotation of 36° each minute to replace said first numbered ball with a next successive first numbered ball, for moving said second carousel through a rotation of 60° every ten minutes to replace said second numbered ball with a next successive second numbered ball, and for moving said third carousel through a rotation of 30° every hour to replace said third numbered ball with a next successive third numbered ball.

4. The novelty clock of claim 3 wherein said time display control mechanism includes:

a timing device for measuring one minute intervals:

a motor actuated by said timing device at each one minute interval, said motor having an output shaft which is rotated when said motor is actuated; and a drive mechanism for rotating at least said first carousel when said motor is actuated.

5. The novelty clock of claim 4 wherein said drive mechanism includes:

a first pulley mounted on and rotated by said motor output shaft;

a second pulley mounted on said housing;

a belt received about each of the first and second pulleys in an endless configuration;

a grid to which is secured said belt, said grid being slidably mounted to said housing to allow vertical movement in either direction of said grid, said grid being moved through one cycle each minute, said cycle including being moved from a lowermost position to an uppermost position, and back to said lowermost position;

a first engagement device for engaging said first carousel to impart rotation on said first carousel as said grid is moved vertically;

a second engagement device for engaging said second carousel to impart rotation on said second carousel as said first carousel is rotated through one complete revolution; and a third engagement device for engaging said third carousel to impart rotation on said third carousel as said second carousel is rotated through one complete revolution.

6. The novelty clock of claim 5 wherein each of said first engagement device, said second engagement device and said third engagement device includes:

a pivoting engagement member;

an array of fixed engagement members positioned to be engaged by said pivoting engagement member; and a biasing device for biasing said pivoting engagement member such that as said grid begins its descent, said pivoting engagement member engages one of said array of fixed engagement members, thus imparting downward rotation.

7. The novelty clock of claim 6 wherein said array of fixed engagement members of said first engagement device includes ten said fixed engagement members, and wherein said biasing device is a weight for normally biasing said pivoting engagement device toward said first carousel.

8. The novelty clock of claim 6 wherein said array of fixed engagement members of said second engagement device includes six said fixed engagement members, and wherein said biasing device includes a first magnet carried by said first carousel and a second magnet carried by said pivoting engagement member, said first magnet being positioned to bias said pivoting engagement member toward said second carousel once during each revolution of said first carousel.

9. The novelty clock of claim 6 wherein said array of fixed engagement members of said third engagement device includes twelve said fixed engagement members, and wherein said biasing device includes a first magnet carried by said second carousel and a second magnet carried by said pivoting engagement member, said first magnet being positioned to bias said pivoting engagement member toward said third carousel once during each revolution of said second carousel.

10. The novelty clock of claim 5 wherein said drive mechanism further includes a first limit switch and a second limit switch, said first limit switch being positioned to reverse direction of said motor when said uppermost limit of said grid is reached, said second limit switch being positioned to stop said motor when said lowermost limit of said grid is reached.

11. The novelty clock of claim 4 said drive mechanism includes:

a cam plate mounted on said output shaft of said motor;

a cam eccentrically carried on said cam plate;

a grid defining a cam slot, said grid being slidably mounted to said housing to allow vertical movement in either direction of said grid, said grid being moved through one cycle each minute, said cycle including being moved from a lowermost position to an uppermost position, and back to said lowermost position, said motor being oriented such that said cam is received in said cam slot;

a first engagement device for engaging said first carousel to impart rotation on said first carousel as said grid is moved vertically;

a second engagement device for engaging said second carousel to impart rotation on said second carousel as said first carousel is rotated through one complete revolution; and a third engagement device for engaging said third carousel to impart rotation on said third carousel as said second carousel is rotated through one complete revolution.

12. The novelty clock of claim 11 wherein each of said first engagement device, said second engagement device and said third engagement device includes:

a pivoting engagement member;

an array of fixed engagement members positioned to be engaged by said pivoting engagement member; and a biasing device for biasing said pivoting engagement member such that as said grid begins its descent, said pivoting engagement member engages one of said array of fixed engagement members, thus imparting downward rotation.

13. The novelty clock of claim 12 wherein said array of fixed engagement members of said first engagement device includes ten said fixed engagement members, and wherein said biasing device is a weight for normally biasing said pivoting engagement device toward said first carousel.

14. The novelty clock of claim 12 wherein said array of fixed engagement members of said second engagement device includes six said fixed engagement members, and wherein said biasing device includes a first magnet carried by said first carousel and a second magnet carried by said pivoting engagement member, said first magnet being positioned to bias said pivoting engagement member toward said second carousel once during each revolution of said first carousel.

15. The novelty clock of claim 12 wherein said array of fixed engagement members of said third engagement device includes twelve said fixed engagement members, and wherein said biasing device includes a first magnet carried by said second carousel and a second magnet carried by said pivoting engagement member, said first magnet being positioned to bias said pivoting engagement member toward said third carousel once during each revolution of said second carousel.

16. The novelty clock of claim 1 further comprising a lifting mechanism for pivoting said display shelf upward to encourage each of said first numbered ball, said second numbered ball and said third numbered ball toward each of said first carousel, said second carousel and said third carousel, respectively, said lifting mechanism including a cable connected at one end to said shelf proximate a distal edge thereof, said cable being received through an opening defined in said housing front panel, around a pulley carried below said grid, and secured at an opposite end to said grid, said time display shelf being pivoted upward during upward movement of said grid and being lowered during downward movement of said grid.

17. A novelty clock comprising:

a housing having at least a front panel defining a time display opening;

a display shelf carried by said front panel below said time display opening;

a time display including a first numbered ball representing a one minute increment, a second numbered ball representing a ten minute increment, and a third numbered ball representing a one hour increment, said first numbered ball, said second numbered ball and said third numbered ball each being displayed on said display shelf;

a first carousel defining an array of ten ball receiving cells for receiving ten numbered balls representing zero through nine for use as said first numbered ball;

a second carousel defining an array of six ball receiving cells for receiving six numbered balls representing zero through five for use as said second numbered ball;

a third carousel defining an array of twelve ball receiving cells for receiving twelve numbered balls representing one through twelve for use as said third numbered ball;

a lifting mechanism for pivoting said display shelf upward to encourage each of said first numbered ball, said second numbered ball and said third numbered ball toward each of said first carousel, said second carousel and said third carousel, respectively, said lifting mechanism including a cable connected at one end to said shelf proximate a distal edge thereof, said cable being received through an opening defined in said housing front panel, around a pulley carried below said grid, and secured at an opposite end to said grid, said time display shelf being pivoted upward during upward movement of said grid and being lowered during downward movement of said grid; and a time display control mechanism for moving said first carousel through a rotation of 36° each minute to replace said first numbered ball with a next successive first numbered ball, for moving said second carousel through a rotation of 60° every ten minutes to replace said second numbered ball with a next successive second numbered ball, and for moving said third carousel through a rotation of 30° every hour to replace said third numbered ball with a next successive third numbered ball, said time display control mechanism including:

a timing device for measuring one minute intervals:

a motor actuated by said timing device at each one minute interval, said motor having an output shaft which is rotated when said motor is actuated; and a drive mechanism for rotating at least said first carousel when said motor is actuated.

* * * * *